US008307740B2

(12) United States Patent
Minkes et al.

(10) Patent No.: US 8,307,740 B2
(45) Date of Patent: Nov. 13, 2012

(54) CUTTER UNIT FOR A ROTARY SHAVER, METHOD FOR MAKING SUCH A UNIT AND ROTARY SHAVER PROVIDED THEREWITH

(75) Inventors: Willem Minkes, Drachten (NL); Paul-Rainer Viktor Karl Slesazeck, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 505 days.

(21) Appl. No.: 11/718,378

(22) PCT Filed: Oct. 28, 2005

(86) PCT No.: PCT/IB2005/053521

§ 371 (c)(1),
(2), (4) Date: May 1, 2007

(87) PCT Pub. No.: WO2006/048798

PCT Pub. Date: May 11, 2006

(65) Prior Publication Data

US 2009/0019703 A1 Jan. 22, 2009

(30) Foreign Application Priority Data

Nov. 1, 2004 (EP) ..... 04105433

(51) Int. Cl.
*B26B 19/14* (2006.01)

(52) U.S. Cl. ..... 76/115; 30/43.6; 30/346.51; 83/13

(58) Field of Classification Search ..... 30/43.6, 30/346.51, 43.4, 43.5, 43.7; 76/115; 83/13
See application file for complete search history.

(56) References Cited

U.S. PATENT DOCUMENTS

| | | | | | |
|---|---|---|---|---|---|
| 2,494,463 | A | * | 1/1950 | Wilhelmus | 30/34.2 |
| 2,824,367 | A | * | 2/1958 | McWilliams | 30/41.5 |
| 3,116,551 | A | * | 1/1964 | Anton | 30/43.6 |
| 3,636,626 | A | | 1/1972 | Zuurveen | |
| 3,844,033 | A | * | 10/1974 | Yonkers | 30/43.5 |
| 4,192,065 | A | * | 3/1980 | Tietjens | 30/43.6 |
| 4,222,168 | A | * | 9/1980 | Boiten et al. | 30/43.6 |
| 4,227,301 | A | | 10/1980 | Van Hemmen et al. | |
| 4,240,199 | A | * | 12/1980 | Boiten et al. | 30/43.6 |
| 4,258,470 | A | * | 3/1981 | Boiten et al. | 30/43.6 |
| 4,281,453 | A | | 8/1981 | Bakker et al. | |
| 4,343,086 | A | * | 8/1982 | de Vries et al. | 30/43.6 |
| 4,393,586 | A | * | 7/1983 | Hamashima et al. | 30/43.6 |
| 4,707,923 | A | | 11/1987 | Tietjens | |
| 4,979,297 | A | | 12/1990 | Bertram et al. | |
| 5,390,416 | A | | 2/1995 | Uchiyama | |
| 5,444,914 | A | * | 8/1995 | Dekker et al. | 30/43.6 |
| D365,420 | S | * | 12/1995 | Momose | D28/50 |
| D405,231 | S | * | 2/1999 | Nakano | D28/50 |
| 6,199,282 | B1 | * | 3/2001 | Uchiyama et al. | 30/43.6 |

(Continued)

FOREIGN PATENT DOCUMENTS

EP 1063066 12/2000

(Continued)

*Primary Examiner* — Boyer D Ashley
*Assistant Examiner* — Jennifer Swinney

(57) ABSTRACT

A cutter unit for a rotary shaver includes a series of cutters arranged in at least two rings around a central axis of a cutter unit. The rings are formed by forming two cutter discs, each with a plurality of cutters, and by nesting the discs, one into the other, in such way that their combined cutters form the at least two rings.

16 Claims, 3 Drawing Sheets

U.S. PATENT DOCUMENTS 6,502,309 B2 * 1/2003 De Vries et al. ..... 30/34.2
6,515,253 B1 * 2/2003 Battaglia ..... 219/121.67
6,581,289 B2 * 6/2003 Nakano ..... 30/43.6
6,823,590 B2 * 11/2004 Uchiyama et al. ..... 30/43.6
6,868,611 B2 * 3/2005 Geertsma et al. ..... 30/43.6
6,881,923 B2 * 4/2005 Battaglia ..... 219/121.67
6,952,879 B2 * 10/2005 Okabe ..... 30/346.51

FOREIGN PATENT DOCUMENTS

EP 1063066 A1 * 12/2000
EP 1354676 A1 10/2003

* cited by examiner

CUTTER UNIT FOR A ROTARY SHAVER, METHOD FOR MAKING SUCH A UNIT AND ROTARY SHAVER PROVIDED THEREWITH

The invention relates to a cutter unit for a rotary shaver, comprising a series of cutters, arranged in at least two rings around a central axis of the cutter unit.

Such a cutter unit is known from U.S. Pat. No. 5,390,416. This known unit is made from a single piece of material (hereinafter called a blank), by cutting from this material a series of identical arms, which extend radial from a central base and are each provided with a bifurcated, U-shaped end portion. These end portions are bent upward and twisted over about 90°, so that the legs of all U-shaped ends form two concentric rings of cutters. In an alternative embodiment, the blank is cut into a series of radial arms, having three different lengths. Each arm is at its end provided with a cutter, which is bent upward. Thanks to the different arm lengths, the cutters are grouped in three concentric rings.

An advantage of this known cutter unit is that it can be made by cutting and bending, which are rather simple operations that can be done quite accurately, allowing the cutters to be positioned with high precision. Moreover, the unit is made from a single component and hence free from complicated and time-consuming assembly operations.

A disadvantage however is that the number of concentric rings per unit and/or the maximum number of cutters per ring may be limited.

It is an object of the invention to provide a cutter unit of the above-described type, in which the disadvantage of the known cutter unit is avoided, while maintaining advantages thereof. To that end a cutter unit according to the invention comprises at least two cutter discs, each provided with a plurality of cutters, where one of the discs is nested into the other (in such way that the combined cutters form at least two rings.

By forming the cutter unit from at least two cutter discs, which are each provided with a plurality of cutters and which at some stage in the manufacturing process are interconnected so as to become nested one into the other, a cutter unit can be produced with a large number of cutter rings and/or a large number of cutters per ring.

It is noted that in this description the term 'nested' means that one cutter disc is at least partly surrounded by another cutter disc, wherein the surrounded cutter disc may or may not be retractable from the surrounding cutter disc.

In one embodiment, a series of cup-shaped cutter discs can be formed, each including an upstanding ring of cutters of different diameter. These discs can be nested with decreasing diameters. In this way, the number of rings per cutter unit can be simply increased (or decreased) by nesting more (or less) cutter discs. Each ring can have an acceptable number of cutters, as every ring will belong to a separate cutter disc, formed from a separate blank. Also, the number of cutters per ring can be selected independently from each other.

In one embodiment, the number of cutters per ring can be increased by having cutters of at least two cutter discs participate in forming a single cutter unit ring, for instance by bending some cutters of an inner disc radial outward and/or by bending some cutters of a surrounding outer disc radial inward, so as to align these cutters into forming a single ring. In this way, it is possible to increase for instance the number of cutters of the outer ring or rings, which may be advantageous because during use the tangential cutter speed at these rings will be highest, resulting in most effective shaving action.

In a further embodiment, the number of cutter rings can be increased by forming some of the cutter discs with more than one cutter ring. This can for instance be done by bending some cutters more outward and/or inward than others, that is away from, respectively towards the central axis of the cutter unit, as described in a patent application of applicant titled "Cutter member for a rotary shaver, method for making such a member and rotary shaver provided therewith", having the same filing date of the present application. This application is herein incorporated by reference.

The abovementioned bending operation on the cutters can be done before nesting the respective cutter discs. Of course, in such case, the resulting bent cutter discs need to be of nestable shape.

The invention furthermore relates to a method for making a cutter unit. With this method, two or more cutter discs can be formed using any suitable production method, for instance by cutting, stamping, bending and/or forging. The discs can subsequently be nested.

In a preferred embodiment the respective cutter discs are formed by cutting and bending a blank, preferably into a cup-shape. The cutting and bending operation enable precise positioning of the cutters, whereas the cup-shape allows the various discs to be readily nested. The discs may be provided with appropriate ribs, recesses, and the like, which may help in aligning the respective discs during nesting and prevent the discs against relative movement.

Further advantageous embodiments of a cutter unit, a rotary shaver equipped therewith and a method for making the cutter unit are set forth in the dependent claims.

To explain the invention, exemplary embodiments thereof will now be described with reference to the accompanying drawings, wherein.

In this description, identical or corresponding parts have identical or corresponding reference numerals.

Figure 1:
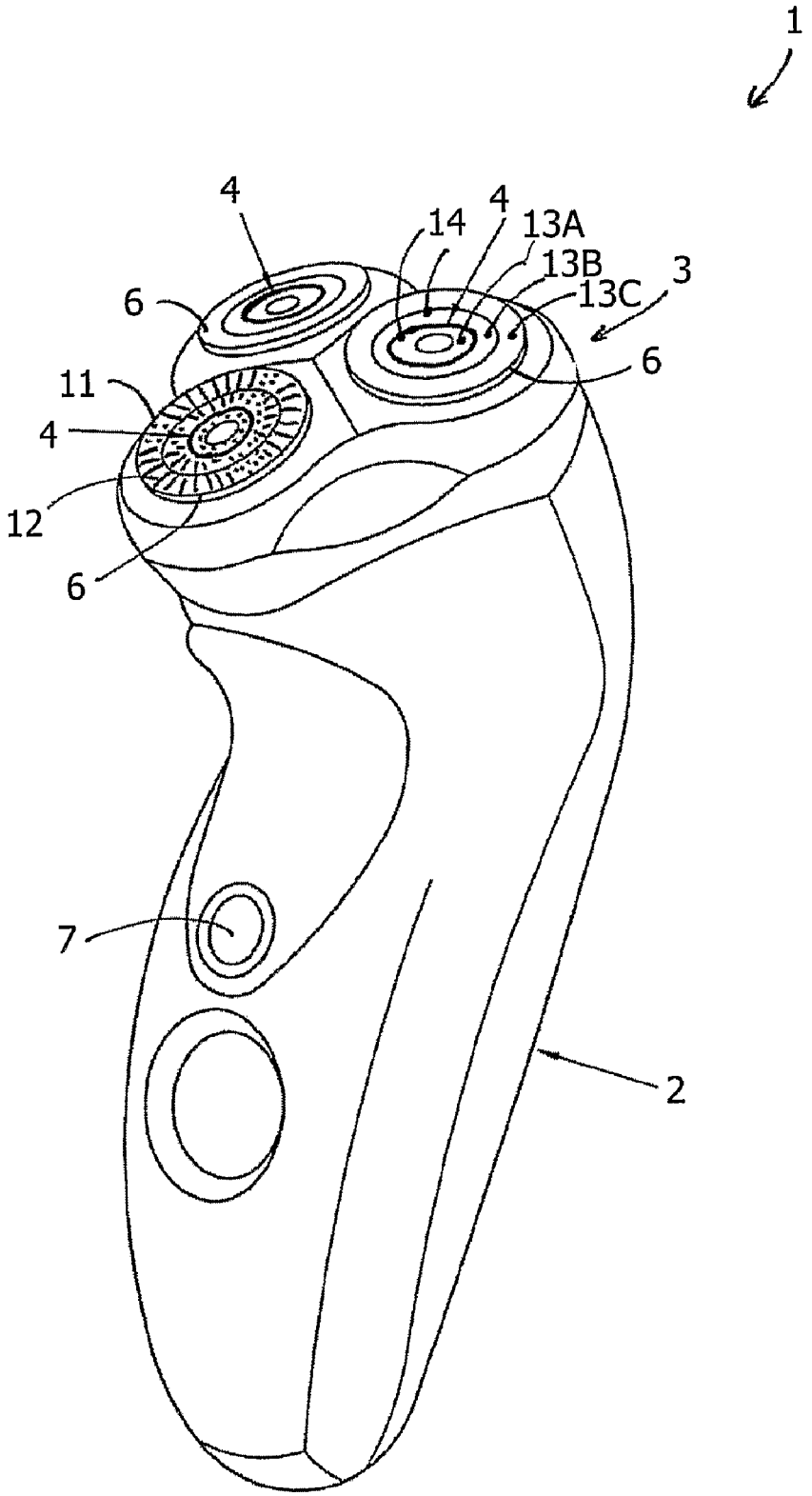
FIG. 1 shows in perspective view a rotary shaver according to the invention, provided with three shaving heads, having concentric annular shaving sections.

FIG. 1 shows a typical example of a rotary shaver 1, comprising a housing 2, provided with a shaver head holder 3, which includes three shaver heads 4. Each shaver head 4 comprises a cap 6, which in use is brought into contact with a user's skin, and a cutter assembly 10, which is rotatably mounted in the shaver head holder 3, below the cap 6, and in use is driven by a motor and suitable transmission means (not shown), accommodated in the housing 2. The housing 2 may further accommodate a power supply (not shown) and a power switch 7.

Each cap 6 is provided with a number of hair entry apertures 11, 12 and two concentric annular grooves 14 (or ribs), which divide the cap 6 into three concentric shaving sections 13A-C. These sections 13A-C form, at their bottom side, between the grooves 14, tracks in which cutters of the abovementioned cutter assembly 10 can rotate, thereby co-operating with the edges of said apertures 11, 12 to cut off any hairs or stubs entering said apertures 11, 12. The grooves or ribs 14 have a stiffening effect on the cap 6. Consequently, the wall thickness of the cap 6 can be reduced, allowing hairs to be cut closer to the skin and/or the number of hair-entry apertures 11, 12 can be increased, allowing hairs to enter the cap 6 more readily and increasing the number of edges with which the cutters can cooperate to severe entering hairs.

As furthermore shown in FIG. 1, the hair-entry apertures can be of different design, for instance round 11 and slit-shaped 12. The round apertures 11 are in the given example concentrated in the center of the cap 6, where the cutting speed in use will be lowest, and are generally believed to be most efficient for cutting stubs, since thanks to their limited size, the wall thickness of the cap 6 may locally even further be reduced, allowing these stubs to be shaved very close to the skin. The slits 12 on the other hand, are generally believed to be good in trapping and re-orienting longer hairs, and are therefore in the present embodiment located more towards the circumferential edge of the cap 6, where in use the cutting speed will be highest. Of course, in alternative embodiments, the shapes, combinations and/or distribution of the apertures 11, 12 may be different. Also, the cap 6 may be provided with more or less annular sections 13.

The cutter assembly 10 will now be described in more detail with reference to FIG. 2, in which an example of a cutter assembly is shown, in exploded view. The assembly comprises, from top to bottom, a cutter unit 5, a hair pulling member 17 and a coupling body 18, arranged to hold the other components together.

The cutter unit 5 is composed of several cutter discs, in the given example two discs, in particular a first cutter disc 15 and a second cutter disc 16. The first cutter disc 15 comprises nine cutters 20', 20", which are integrally connected to a central base plate 21 via a corresponding number of upwardly bent arms 22', 22". Of course, in an alternative embodiment the number of cutters and/or arms may be altered. The cutters are arranged in two rings, preferably concentrically around a central axis C of the cutter unit 5, which during use coincides with a rotation axis of the assembly 10. The inner ring $R_1$ with diameter $D_1$ contains three cutters 20', obtained by bending an end portion of three arms 22' inward, i.e. towards the rotation axis C, around a first bending axis $B_1$. The outer ring $R_2$ with diameter $D_2$ contains six cutters 20" obtained by bending an end portion of the remaining six arms 22" outward, i.e. away from the rotation axis C, around a second bending axis $B_2$. It will be clear, that the number of cutters 20', 20" per ring $R_{1,2}$ can be varied. For instance, both rings $R_{1,2}$ may be provided with an equal number of cutters 20', 20" by alternately bending an arm inward and outward. Therefore, the above given numbers should in no way be construed as limiting.

Figure 2:
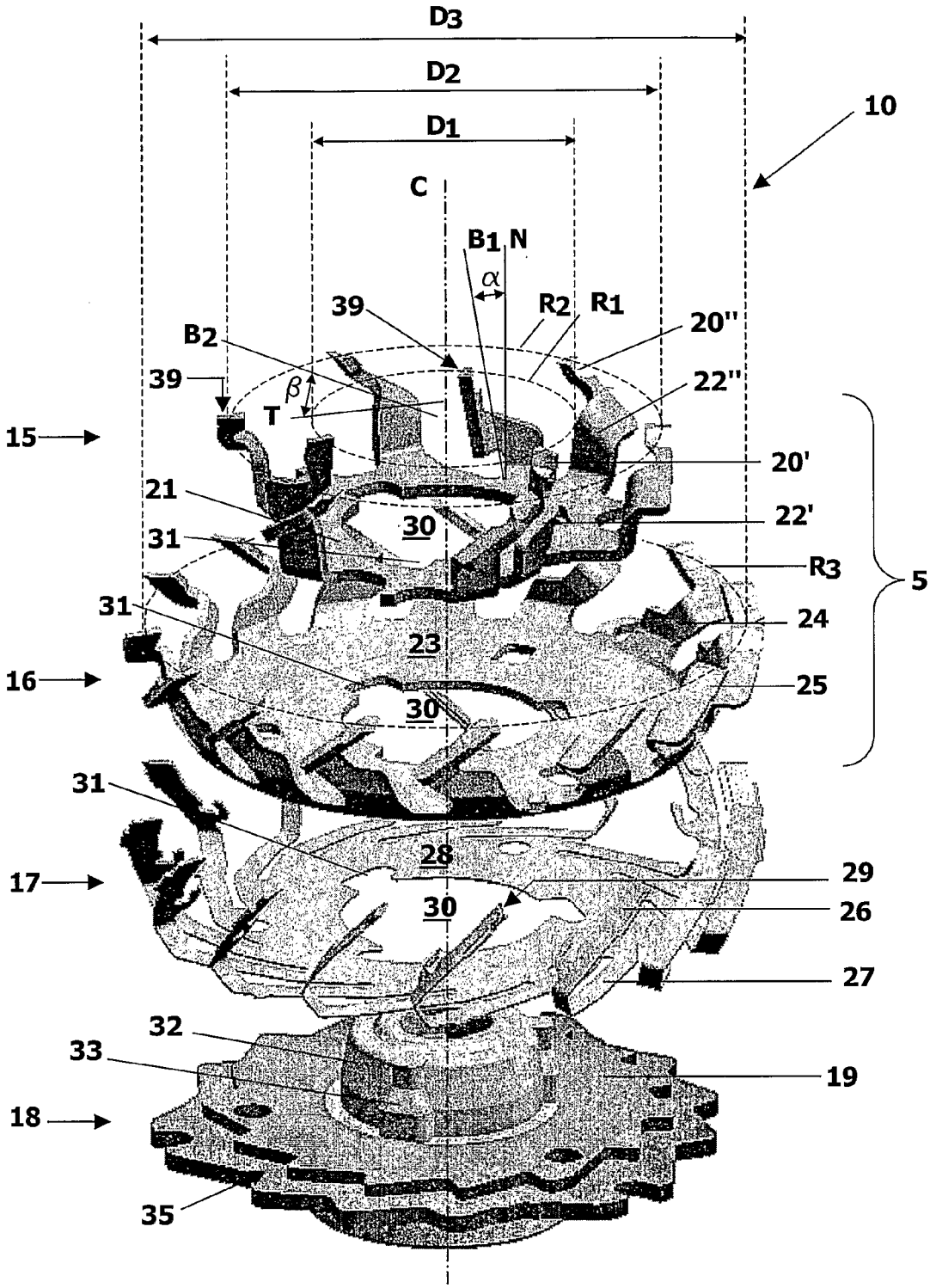
FIG. 2 shows in exploded view a cutter assembly for a shaver head, comprising a cutter unit according to the invention, composed of two nested cutter discs.

As can be appreciated from FIG. 2, the shape of the arms 22', 22" and the orientation of the first and second bending axes $B_1$,$B_2$ are chosen such, that the cutters 20', 20" have a slightly slanted orientation, with respect to a vertical plane. To that end the first bending axis $B_1$ includes an acute angle $\alpha$ with a normal N of the base plate 23. The second bending axis $B_2$ includes an acute angle $\beta$ with a tangent T of the upright portion of the arms 22". It is noted that the illustrated bending directions may be reversed, i.e. arms 22' may be bent outward around the first bending axis $B_1$, whereas the other arms 22" may be bent inward around the second bending axis $B_2$. It is also possible to bent all arms outward, respectively inward, but some arms more than others. The skilled person will furthermore understand, that the shape of the various arms may differ and can be customized to the various bending directions. Moreover, said shapes and bending directions can be adapted so as to make optimum use of the starting material (blank), wasting as little material thereof as possible.

In an alternative embodiment, the first cutter disc 15 may be provided with more than two cutter rings $R_{1,2}$. For instance, to form three concentric rings $R_{1,2,3}$ (not shown), a first group of arms 22' may be bent inward similar to or preferably slightly further than the arms shown in FIG. 2, a second group of arms 22" may be bent outward, similar to or preferably slightly further than the arms shown in FIG. 2, and a third group of arms 22'" may be bent straight upward so as to form an intermediate, third ring $R_3$ with cutters 20'".

Additionally or alternatively, in order to increase the number of concentric rings $R_x$ at least some of the arms 22 may be provided with and end portion featuring multiple cutters 20, for instance a U-shaped or W-shaped end portion, having two, respectively three cutter legs (not shown).

Figure 3:
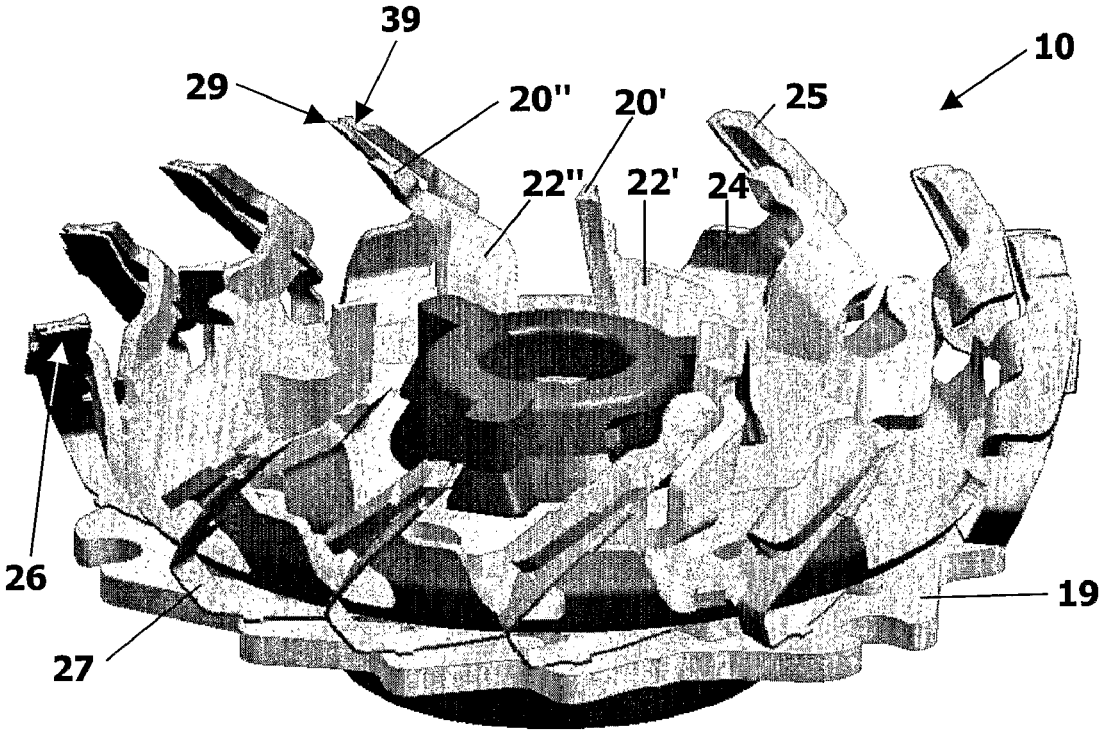
FIG. 3 shows the cutter assembly of FIG. 2, in assembled view.

The second cutter disc 16 is in the given example of cup-shaped design, comprising a single ring $R_3$ of cutters 25, which are integrally connected to a central base plate 23 via a series of upwardly bent arms 24. An upper end of these arms 24 is bent outward in a similar way as the arms 22" of the first cutter disc 15, so that the cutters 25 have a slightly slanted orientation with respect to a vertical plane. Moreover, the diameter $D_3$ of the cutter ring $R_3$ is larger than the ring diameters $D_1$, $D_2$ of the first cutter disc 15, so that this disc 15 can be nested in the second cutter disc 16, as seen in FIG. 3, to form a composite cutter unit 5 according to the invention, with three concentric rings $R_{1,2,3}$ of cutters 20', 20", 25.

In another embodiment, instead of the first cutter disc 15, the second cutter disc 16 may be provided with multiple concentric rings $R_x$ of cutters 25', 25" (not shown). Alternatively, both discs 15, 16 may be provided with multiple concentric rings. Such multiple rings of cutters may be realized in a similar way as described with reference to the first cutter disc 15.

The above described cutter discs 15, 16 can each be made by cutting the desired number of arms and cutters from a blank, and by bending these arms upward (disc 16) and radial inward and outward (disc 15). Next, the first disc 15 can be nested in the second disc 16. Preferably, the blanks are not configured as single blanks, but rather form part of a (semi-) continuous strip, from which the disc is preferably only cut loose after having attained its final bent shape. The strip allows for easy transport of the intermediate products along consecutive manufacturing stations and/or (temporarily) storing of the products by winding the strip around a reel.

The cutting assembly 10 may furthermore comprise a hair pulling member 17, as shown in FIG. 2, which in the illustrated example can cooperate with the cutter unit 5, in particular its outer ring $R_3$ of cutters 25, to help cutting off hairs as close to the skin as possible. To that end the hair pulling member 17 is provided with a number of hair pulling elements 26 corresponding to the number of cutters 25. Each hair-pulling element 26 is connected to a central base 28 via a biasing arm 27. In assembled condition, these arms 27 act as springs, biasing the pulling elements 26 against a lower side of the cutters 25, in such way that a free edge 29 of the hair pulling element 26 leads in rotation direction with respect to a cutting edge 39 of the corresponding cutter 25 (as best seen in FIG. 3). This ensures, that in use, when the cutting assembly 10 is rotated, the edge 29 will encounter and engage a hair before the cutting edge 39 does. The biasing arm 27 is designed such, that under influence of a force exerted thereon by the hair, it will deflect downward, thereby pulling the hair further into the aperture 11, 12. As a consequence, the hair can be cut closer to the skin by the passing cutter edge 39. For a more detailed description of the hair pulling member 17 and its working principle, reference is made to EP 0 019 954 of applicant, which description is understood to be incorporated herein by reference.

In an alternative embodiments, more hair pulling elements 26', 26" may be provided (not shown), to cooperate with the respective cutters 20', 20" of the first cutter disc 15. To that end, a second hair pulling member may be provided (not shown) having a similar configuration as the one shown in FIG. 2, but of smaller diameter, so as to be nestable between the first and second cutter discs 15, 16. Such second hair pulling member may be designed to have two rings of hair pulling elements, arranged to co-operate with the two rings of cutters 20', 20" of the first cutting member 15. Alternatively, such second hair pulling member may be provided with one ring of hair pulling members, arranged to co-operate with the outer ring of cutters 20" of the first cutting member 15. In the latter case, a third hair pulling member (not shown) may be provided, to co-operate with said inner ring of cutters 20'. Said third hair pulling member may for instance be designed to be slid around the inner ring $R_1$ from an upper side of the assembly 10 and be subsequently rotated into place, thereby sliding the pulling arms under the respective cutters and locking the member against further rotation.

The cutter assembly 10 of FIG. 2 further comprises a coupling body 18, on which the previously described cutter discs 15, 16 and hair pulling member 17 can be mounted. These components 15-17 are thereto each provided with a central opening 30, provided with three recesses 31, in which a central stub 32 of the coupling body 18 can fit with three ribs 33. The ribs 33 and recesses 31 cooperate to align the various components correctly and, once assembled, prevent relative rotation there between.

The coupling body 18 furthermore comprises a cover plate 19, provided with a stepped, saw-toothed circumference 35, wherein the upper surface is arranged to support the arms 27 of the hair pulling member 17 in biased condition, and the stepped surface allows said arms to deform downwards to perform their hair pulling function, and at the same time serves to limit said downward movement.

In short, by nesting a series of cutter discs 15, 16 as described, a cutter unit 5 can be formed with a large number of cutter rings and/or a large number of cutters per ring. In a most simple embodiment, the number of nested discs can be equal to the number of desired cutter rings, wherein each disc forms one ring. In such embodiment, the cutter discs can be of cup-shaped design, which can be simply manufactured, for instance by cutting and stamping a piece of sheet material. In a more sophisticated embodiment, some or each of the nested cutter discs may contribute to several rings, by bending the cutters in appropriate directions. Additionally or alternatively, some of the discs may be provided with more than one ring of cutters, again by bending the cutters in appropriate directions.

The invention is not in any way limited to the exemplary embodiments presented in the description and drawing. Many variations thereon are possible. These variations, as well as all combinations (of parts) of the embodiments shown and described in this description are explicitly understood to be incorporated in this description and to fall within the scope of this invention, as outlined by the following claims.

The invention claimed is:

1. A cutter unit for a rotary shaver, the cutter unit comprising at least two cutter discs for cutting hair having a plurality of cutters, wherein a first disc of the at least two cutter discs has two cutter rings, and a second disc of the at least two cutter discs has only a single cutter ring, and wherein a diameter of the single cutter ring is larger than diameters of the two cutter rings of the first disc so that the first disc is nested in the second disc to form a composite cutter unit where the plurality of cutters are arranged in three concentric cutter rings, wherein an outer ring of the two cutter rings of the first disc comprises more cutters than an inner ring of the two cutter rings of the first disc.

2. The cutter unit according to claim, 1, wherein the two rings of the first disc are formed by bending some of the cutters of the first disc more outward and/or inward than others.

3. The cutter unit according to claim 1, wherein the at least two cutter discs are of substantial cup-shaped design, each having a central base surrounded by at least one ring of cutters, said cutters extending substantially upright from said central base.

4. The cutter unit according to claim 1, wherein a number of cutters are different per ring.

5. The cutter unit according to claim 1, wherein the two cutter rings of the first disc are configured to provide alternating inner and outer cutters that extend from only one of an outer perimeter and an inner perimeter of the first disc.

6. The cutter unit of claim 1, further comprising a hair pulling member for pulling the hair for cutting by the at least two cutter discs.

7. The cutter unit of claim 1, further comprising a cap for accommodating the at least two cutter discs, wherein the cap has round hair-entry apertures and slit-shaped hair-entry apertures.

8. The cutter unit of claim 7, wherein the round hair-entry apertures are located near a center of the cap, and the slit-shaped hair-entry apertures are located near a circumferential edge of the cap.

9. A rotary shaver comprising at least one cutter unit, the cutter unit comprising at least two cutter discs for cutting hair having a plurality of cutters, wherein a first disc of the at least two cutter discs has two cutter rings, and a second disc of the at least two cutter discs has only a single cutter ring, and wherein a diameter of the single cutter ring is larger than diameters of the two cutter rings of the first disc so that the first disc is nested in the second disc to form a composite cutter unit where the plurality of cutters are arranged in three concentric cutter rings, wherein an outer ring of the two cutter rings of the first disc comprises more cutters than an inner ring of the two cutter rings of the first disc.

10. The rotary shaver of claim 9, further comprising a hair pulling member for pulling the hair for cutting by the at least two cutter discs.

11. The rotary shaver of claim 9, wherein the two cutter rings of the first disc are configured to provide alternating inner and outer cutters that extend from only one of an outer perimeter and an inner perimeter of the first disc.

12. A method for making a cutter unit for a rotary shaver, comprising the acts of:

forming at least two cutter discs for cutting hair;

providing each of the at least two cutter discs with a plurality of cutters to be arranged in rings of different diameters;

nesting the at least two cutter discs so as to form a composite cutter unit with at least two concentric rings of cutters, wherein a first disc of the at least two cutter discs has two cutter rings, and a second disc at least two cutter discs has only a single cutter ring, and wherein a diameter of the single cutter ring is larger than diameters of the two cutter rings of the first disc so that the first disc is nested in the second disc to form a composite cutter unit where the plurality of cutters are arranged in three concentric cutter rings, wherein an outer ring of the two cutter rings of the first disc comprises more cutters than an inner ring of the two cutter rings of the first disc.

13. The method according to claim 12, wherein each cutter disc is formed by the acts of:

cutting a blank so as to comprise a plurality of integrally connected arms and cutters; and bending the connected arms so as to arrange the plurality of cutters into a desired position.

14. The method according to claim 13, wherein the blanks form part of a continuous strip, in which the at least two cutter discs remain attached up till the nesting act, so that the strip serves to guide the at least two cutter discs along the acts of cutting and bending.

15. The method of claim 12, further comprising the act of providing a hair pulling member for pulling the hair for cutting by the at least two cutter discs.

16. The method of claim 12, wherein the two cutter rings are configured to provide alternating inner and outer cutters that extend from only one of an outer perimeter and an inner perimeter of the first disc.

* * * * *